US007624845B2

(12) United States Patent
Mustalahti et al.

(10) Patent No.: US 7,624,845 B2
(45) Date of Patent: Dec. 1, 2009

(54) METHOD AND APPARATUS FOR ADJUSTING THE DISTANCE BETWEEN THE CARS OF A DOUBLE-DECK ELEVATOR

(75) Inventors: Jorma Mustalahti, Hyvinkää (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/349,935

(22) Filed: Feb. 9, 2006

(65) Prior Publication Data

US 2006/0201748 A1 Sep. 14, 2006

Related U.S. Application Data

(63) Continuation of application No. PCT/FI2004/000278, filed on May 11, 2004.

(30) Foreign Application Priority Data

Aug. 12, 2003 (FI) ..... 20031148

(51) Int. Cl.
*B66B 9/00* (2006.01)
*B66B 1/42* (2006.01)
*B66B 11/06* (2006.01)

(52) U.S. Cl. ..... 187/249; 187/261; 187/284; 254/266; 254/278

(58) Field of Classification Search ..... 187/249, 187/251, 261, 401, 406, 414, 902, 262, 284; 254/265, 385, 266, 278
See application file for complete search history.

(56) References Cited

U.S. PATENT DOCUMENTS 1,193,893 A * 8/1916 Hammen ..... 187/257
1,782,671 A * 11/1930 Allred, Jr. ..... 414/263
1,914,128 A * 6/1933 James et al. ..... 187/249
1,973,920 A * 9/1934 Wilson ..... 187/249
2,701,032 A * 2/1955 Senn ..... 187/259
4,566,562 A * 1/1986 Suzuki et al. ..... 187/266
4,842,101 A * 6/1989 Lamb ..... 187/266
5,370,205 A * 12/1994 Vanhala ..... 187/264
5,526,901 A * 6/1996 Salmon ..... 187/249
6,193,016 B1 * 2/2001 Hollowell et al. ..... 187/250
6,247,557 B1 * 6/2001 Kobayashi et al. ..... 187/266

FOREIGN PATENT DOCUMENTS

EP 1357075 A1 * 10/2003
JP 04080188 A * 3/1992
JP 10-236753 A 9/1998
JP 11-228058 A 8/1999

(Continued)

*Primary Examiner*—John Q. Nguyen
*Assistant Examiner*—Stefan Kruer
(74) *Attorney, Agent, or Firm*—Birch, Stewart, Kolasch & Birch, LLP

(57) ABSTRACT

A method and apparatus adjust the inter-car distance in a double-deck elevator provided with hoisting ropes, in which elevator the hoisting ropes move a car frame supporting the elevator cars along guide rails. The vertical inter-car distance between the elevator cars is adjusted by moving at least one of the elevator cars in relation to the car frame by pulling the elevator car to be moved upwards and lowering the elevator car to be moved downwards by an adjusting rope.

3 Claims, 3 Drawing Sheets

FOREIGN PATENT DOCUMENTS

| | | | |
|---|---|---|---|
| JP | 2000-309482 | A | 11/2000 |
| JP | 2001-80856 | A | 3/2001 |
| JP | 2001-226048 | A | 8/2001 |
| JP | 2002-255460 | A | 9/2002 |
| WO | WO-02/38482 | A1 | 5/2002 |

* cited by examiner

METHOD AND APPARATUS FOR ADJUSTING THE DISTANCE BETWEEN THE CARS OF A DOUBLE-DECK ELEVATOR

This application is a Continuation of PCT International Application No. PCT/FI2004/000278 filed on May 11, 2004, which designated the United States, and on which priority is claimed under 35 U.S.C. § 120. This application also claims priority under 35 U.S.C. § 119(a) on Patent Application No(s). 20031148 filed in Finland on Aug. 12, 2003. The entire contents of each of the above documents is hereby incorporated by reference.

FIELD OF INVENTION

The present invention relates to a method and to an apparatus for adjusting the distance between the cars of a double-deck elevator.

The present invention relates to a method as defined in the preamble of claim 1 and to an apparatus as defined in the preamble of claim 5 for adjusting the distance between the cars of a double-decker elevator.

The invention relates in particular to adjustment of the car distance between the elevator cars of a so-called double-deck elevator in which the cars are placed one above the other in the same car frame. In this context, adjustment of the inter-car distance is also termed adjustment of the inter-floor distance.

DESCRIPTION OF THE BACKGROUND ART

Elevators having two elevator cars placed one above the other in the same car frame are used e.g. in tall buildings to increase the transport capacity. Such double-deck elevators can serve e.g. as collector elevators.

Traditionally, double-deck elevators have fixed inter-car distances, as described e.g. in the old German patent specification DE1113293. However, double-deck elevators with a fixed inter-car distance involve the problem that in many buildings the distances between floors are not equal. Often, especially in modern tall buildings, the entrance lobby is higher than the other stories. Likewise, the building may have other special stories of varying height. In addition, in tall buildings the tolerances may repeat themselves, and thus the story heights of upper and lower floors may be different. In such buildings, in double-deck elevator solutions with a fixed inter-car distance only one of the cars can be driven exactly to the correct position while the other one remains above or below the floor level by a distance corresponding to the difference.

To solve the above-mentioned problem, double-deck elevators have been developed in which the vertical distance between the elevator cars mounted in the same car frame, i.e. the inter-floor distance can be adjusted. European patent application No. EP1074503 proposes a number of solutions to address the above-mentioned problem. FIG. 1 of the aforesaid publication illustrates a solution wherein the elevator cars in the car frame are raised or lowered in relation to each other and the car frame by means of a motor or equivalent provided in the car frame.

Similarly, FIG. 2 illustrates another prior-art solution, which corresponds to e.g. U.S. Pat. No. 5,907,136. In this known solution, the elevator cars in the car frame are raised or lowered in relation to each other and the car frame by means of a jack and a scissors mechanism provided in the car frame. In addition, the car frame comprises an intermediate beam, which carries the fixing point of the joint of the scissors mechanism. The upper car is raised by means of a hoisting device provided in the car frame, such as a motor or by rotating lifting screws or by means of power cylinders. When the upper car is moving in one direction, the lower car, driven by the scissors mechanism, is simultaneously moving in the other direction.

The aforesaid EP specification EP1074503 itself proposes two elevator cars placed one above the other in the car frame and coupled to be moved by thick screw bars in relation to each other and the car frame. The screw bar moving the upper car and the screw bar moving the lower car have threads of opposite pitch, and consequently the elevator cars move in opposite directions when the screw bars are rotated. The drive motor of the screw bars is placed in the upper part of the car frame.

Although the prior-art solutions referred to above do overcome the aforesaid drawback caused by a fixed inter-car distance in double-deck elevators, these solutions are not without problems. All the above-mentioned solutions are complicated in structure and involve unnecessary additional weight in the car frame. Moreover, they take up space that would be needed for other equipment in the car frame. A further problem is that the drive means, such as motors and power cylinders in the car frame require operating energy, which has to be supplied to the moving car frame from outside. For example, an electric motor requires separate supply of power via the car cable to the car frame. Likewise, the power cylinders or equivalent need their own power supply. An additional problem is that the devices moving with the car frame are difficult to adjust and maintain because these operations have to be performed in the elevator shaft on the top of the car frame or otherwise in connection with the car frame.

BRIEF SUMMARY OF THE INVENTION

The solution of the present invention aims at eliminating the above-mentioned drawbacks and providing a reliable and economical method and apparatus for adjusting the inter-car distance of a double-deck elevator, in which solution at least one of the elevator cars placed one above the other in the car frame can be moved in relation to the car frame and the other elevator car. A further aim is to create a solution for adjustment of the said inter-car distance permitting easy adjustment and maintenance.

The solution of the invention has the advantage of simple and clear structure. A further advantage is that the devices needed for adjustment of the car distance between the elevator cars are disposed in a fixed place either in the machine room or e.g. on the bottom of the elevator shaft. Thus, the adjusting devices are easily accessible and therefore easy to adjust and maintain. Another advantage is that the car frame need not be provided with a supply of electricity to the devices used to adjust the inter-car distance. Due to easy and good adjustability, the elevator cars of the double-deck elevator can be driven accurately to their respective floor levels regardless of things like different loads of the elevator cars, because load compensation can be taken into account in the adjusting device.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail with reference to an example and the attached drawings, wherein.

DETAILED DESCRIPTION OF THE INVENTION

Figure 1:
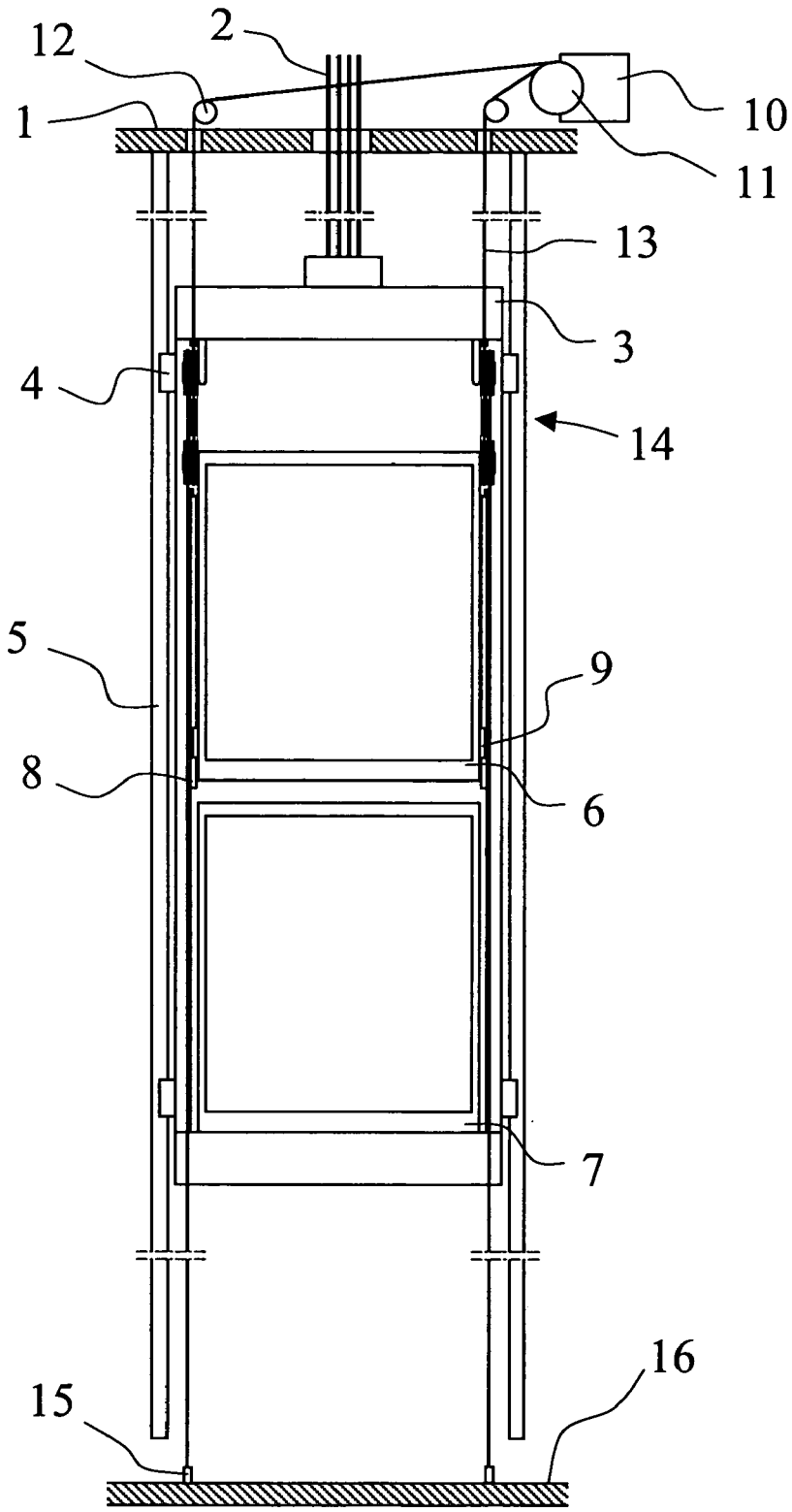
FIG. 1 presents a simplified front view of a double-deck elevator solution applying the invention.

FIG. 1 presents a typical double-deck elevator solution applying the invention, comprising a machine room 1 and below it an elevator shaft with a car frame 3 moving in it along vertical guide rails 5, the car frame being guided by guides 4 and suspended and moved vertically in the elevator shaft with main hoisting ropes 2 by means of an elevator machine not shown in the figure. Placed in the car frame 3 are an upper elevator car 6 and a lower elevator car 7, which are independent of each other and spaced by a vertical distance between them. The lower elevator car 7 is fixedly mounted in the car frame 3 and therefore only moves with the car frame 3, whereas the upper elevator car 6 has been arranged to move along vertical guide rails 8 placed at the inner edge of the car frame 3, with guides 9 guiding the car. The upper elevator car 6 is suspended from the top cross member of the car frame 3 by means of separate adjusting ropes 13 and a set of adjusting wheels 14 in such manner that the upper elevator car 6 can be moved vertically in relation to the car frame 3 and the lower elevator car 7 by an adjusting mechanism 10. The adjusting mechanism 10 is placed in the elevator machine room 1 and the adjusting mechanism comprises at least a rope drum 11 and diverting pulleys 12 disposed in the machine room 1 to guide the adjusting ropes 13. The adjusting mechanism 10 is controlled via the elevator control system. The first end of the adjusting ropes is on the rope drum 11 and the second end is secured to fixing point 15 on the bottom 16 of the elevator shaft.

Figure 2:
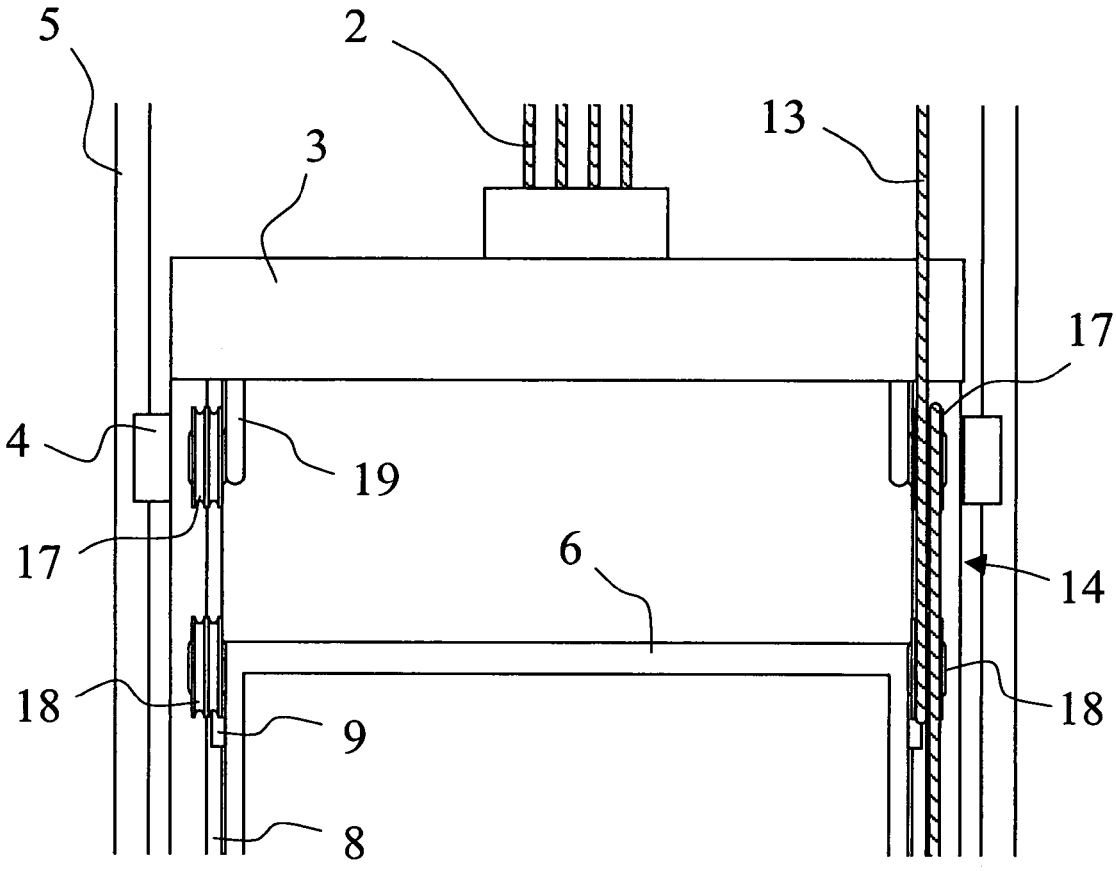
FIG. 2 presents a magnified and simplified front view of a detail at the upper end of the car frame in the solution illustrated in FIG. 1.
Figure 3:
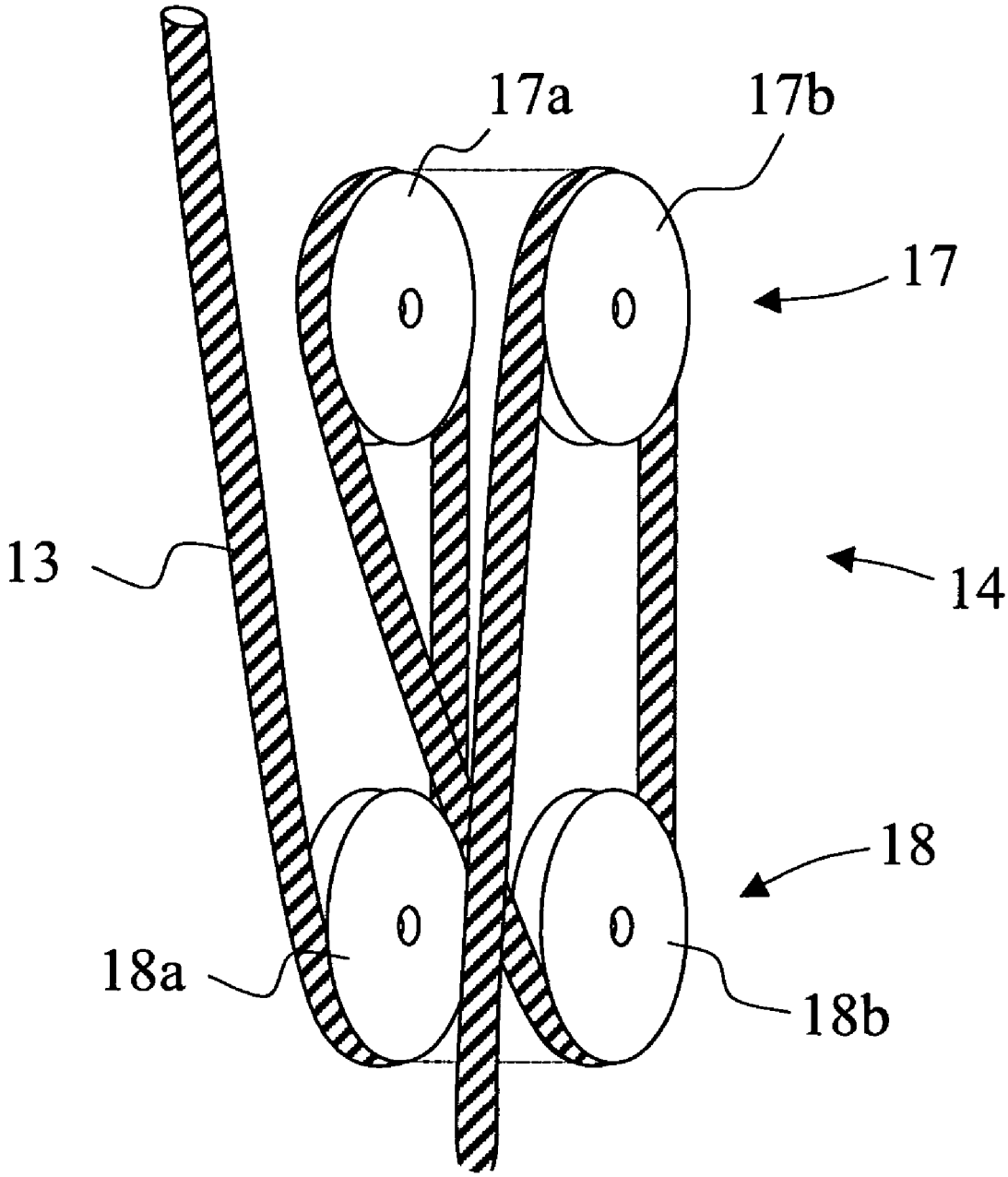
FIG. 3 presents a simplified diagram of a rope arrangement according to the invention for adjustment of the inter-car distance.

FIGS. 2 and 3 give a more detailed illustration of the suspension of the upper elevator car 6 and the set of adjusting wheels 14 according to the invention. The top cross member of the car frame 3 is provided with brackets 19 on which the upper diverting pulleys 17 comprised in the set of adjusting wheels are pivoted, one on either side of the car frame. Correspondingly, the lower diverting pulleys 18 of the set of adjusting wheels are pivoted in the upper part of the upper elevator car 6 substantially directly below the upper diverting pulleys 17 of the set of adjusting wheels. The adjusting rope 13 of the left-hand set of adjusting wheels has been omitted from FIG. 2 for clarity.

The passage of the adjusting rope 13 can be seen best from FIG. 3. Here, for the sake of clarity, the two double-grooved diverting pulleys 17, 18 are presented as two parallel pulleys or grooves 17*a*, 17*b* and 18*a*, l8*b*, although it is actually also possible to use two single-grooved pulleys placed side by side. By following the passage of the adjusting rope 13 from above downwards, one can see that the adjusting rope first comes down from the drum 11 of the adjusting mechanism to the first groove 18*a* of the lower diverting pulley 18, passes under and around the diverting pulley and goes to the first groove 17*a* of the upper diverting pulley 17. Having passed over and around the upper diverting pulley 17 for the first time, the adjusting rope comes again downwards to the lower diverting pulley 18, but this time in an oblique direction, and passes under and around the lower diverting pulley for a second time, now along groove 18*b*. After this, the adjusting rope 13 goes upwards to the second groove 17*b* of the upper diverting pulley 17 and passes over and around the upper diverting pulley 17 for a second time, whereupon the adjusting rope 13 does down to its fixing point 15 on the bottom 16 of the shaft.

When the car frame 3 suspended by the hoisting ropes 2 is moving vertically, the adjusting rope 13 runs at the same rate in the set of adjusting wheels 14 around the diverting pulleys 17 and 18 and the upper elevator car 6 remains stationary in relation to the car frame 3. When the upper car is to be raised or lowered in relation to the car frame or the lower car 7 by means of the adjusting mechanism 10, the adjusting rope 13 is pulled upwards or lowered downwards as necessary. The car frame 3 and the lower elevator car 7 now remain stationary, but the upper elevator car 6 is moving in the vertical direction. When the adjusting rope 13 is pulled upwards in the direction of the adjusting mechanism 10, the loop of the adjusting rope 13 over the diverting pulleys 17 and 18 in the set of adjusting wheels 14 is tightened and the vertical distance between the diverting pulleys is reduced. Thus, the upper elevator car 6 rises and the intercar distance increases. Correspondingly, when the adjusting rope 13 is delivered downwards in the direction away from the adjusting mechanism 10, the loop of the adjusting rope 13 over the diverting pulleys 17 and 18 in the set of adjusting wheels 14 is slackened and the vertical distance between the diverting pulleys 17 and 18 is increased. Thus, the upper elevator car 6 is lowered and the inter-car distance decreases.

By the method of the invention, the adjustment of the vertical distance between the elevator cars is thus accomplished by moving the upper elevator car 6 in the vertical direction by means of the adjusting rope 13 either by pulling the adjusting rope 13 upwards or by lowering it downwards.

It is obvious to the person skilled in the art that different embodiments of the invention are not limited to the example described above, but that they may be varied within the scope of the claims presented below. Thus, to change the distance between the elevator cars in the car frame 3, it is also possible to use other adjusting mechanisms than that described above. For example, the adjusting ropes 13 can also be pulled upwards and lowered downwards by means of hydraulic cylinders or equivalent power cylinders, as well as by means of screw mechanisms, because the adjustment distance is not long.

It is likewise obvious to the skilled person that the adjusting mechanism may be disposed in the lower part of the shaft, in which case the second ends of the adjusting ropes 13 are fastened to the top of the elevator shaft. In addition, the rope suspension of the set of adjusting wheels 14 may differ from the above description in respect of the number of diverting pulleys or grooves and the number of times the adjusting rope is passed around the diverting pulleys.

It is also obvious to the person skilled in the art that, instead of the upper elevator car 6, the lower elevator car 7 may be adjustable in the manner described above by means of adjusting ropes 13, in which case the upper elevator car 6 is correspondingly mounted to be immovable with respect to the car frame 3.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An apparatus for the adjustment of the inter-car distance in a double-deck elevator comprising, hoisting ropes connected to a car frame, the car frame supporting a plurality of elevator cars along guide rails, at least one separate adjusting rope, and a plurality of diverting pulleys, a first elevator car being suspended in the car frame so that it is supported by the at least one adjusting rope and the diverting pulleys, the adjusting rope is moved by an adjusting mechanism that is located off of the car frame, the adjusting mechanism moves the first elevator car relative to the car frame while another one of the elevator cars is stationary relative to the car frame, the adjusting mechanism being non-driven when the hoisting ropes move the car frame, wherein the adjusting mechanism comprises a rope drum to which a first end of the adjusting rope has been secured, and wherein at least part of the adjusting mechanism is disposed in an elevator machine room, a second end of the adjusting rope being secured to a floor of an elevator shaft.

2. The apparatus according to claim 1, wherein the adjusting rope being free of supporting a counterweight for the elevator.

3. A method for adjusting the inter-car distance in a double-deck elevator provided with hoisting ropes, in which elevator the hoisting ropes move a car frame supporting a plurality of elevator cars along guide rails, comprising the step of adjusting a vertical inter-car distance between the elevator cars by moving one of the elevator cars in relation to the car frame by pulling the elevator car to be moved by an adjusting rope, for respective upward and downward movement while another one of the elevator cars is stationary relative to the car frame, wherein movement of the adjusting rope is by an adjusting mechanism that is located off of the car frame, further comprising a rope drum disposed in an elevator machine room and the adjusting rope has a first end secured to the rope drum and a second end secured to a floor of an elevator shaft, the method comprising the step of driving the rope drum to move the one elevator car relative to the car frame.

* * * * *